US008245463B2

(12) United States Patent
Milstead

(10) Patent No.: US 8,245,463 B2
(45) Date of Patent: Aug. 21, 2012

(54) REPLACEMENT WINDOW AND DOOR SEALING FIN AND METHOD

(76) Inventor: Robert J. Milstead, Colleyville, TX (US)

( * ) Notice: Subject to any disclaimer, the term of this patent is extended or adjusted under 35 U.S.C. 154(b) by 100 days.

(21) Appl. No.: 12/489,094

(22) Filed: Jun. 22, 2009

(65) Prior Publication Data

US 2010/0319267 A1 Dec. 23, 2010

(51) Int. Cl.
*E04B 1/04* (2006.01)

(52) U.S. Cl. ..... 52/213; 52/741.4

(58) Field of Classification Search ..... 52/208–213, 52/204.1, 204.55, 716.1, 741.4, 58
See application file for complete search history.

(56) References Cited

U.S. PATENT DOCUMENTS

| | | | | |
|---|---|---|---|---|
| 3,239,977 | A | 3/1966 | Shore | |
| 5,003,738 | A | 4/1991 | Hogeland | |
| 5,119,609 | A | 6/1992 | Tait | |
| 5,590,496 | A * | 1/1997 | Martin et al. | 52/213 |
| 5,839,250 | A * | 11/1998 | Hibler | 52/746.1 |
| 6,161,344 | A | 12/2000 | Blanchett | |
| 6,244,001 | B1 * | 6/2001 | Anastasi | 52/215 |
| 6,314,684 | B1 | 11/2001 | Aviram | |
| 6,526,709 | B1 | 3/2003 | Jacobsen | |
| 7,222,462 | B2 * | 5/2007 | Ellingson | 52/62 |
| 7,392,625 | B2 | 7/2008 | Bruggink | |
| 7,754,304 | B1 * | 7/2010 | Hohmann, Jr. | 428/40.1 |
| 7,799,381 | B2 * | 9/2010 | Lian et al. | 427/282 |
| 7,877,951 | B2 * | 2/2011 | Jacobsen | 52/717.01 |
| 2006/0080902 | A1 * | 4/2006 | Bren | 52/58 |
| 2009/0084044 | A1 * | 4/2009 | Hopkins | 52/58 |
| 2010/0170186 | A1 * | 7/2010 | Hohmann, Jr. | 52/741.4 |

* cited by examiner

*Primary Examiner* — William Gilbert
*Assistant Examiner* — Beth Stephan
(74) *Attorney, Agent, or Firm* — Decker Jones, et al; Brian K. Yost; Geoffrey A. Mantooth

(57) ABSTRACT

The sealing fin is elongated, and includes a central fin portion intersecting a crosspiece portion perpendicular thereto, thus generally forming a "T" shape in a preferred embodiment and an "L" shape in another. The sealing fin may be folded into a flat position and easily rolled. In one aspect of the present invention, the sealing fin has an adhesive layer on one or more surfaces. In another aspect of the present invention, the sealing fin is rigid. In another aspect of the present invention, the sealing fin has a rectangular configuration with a hinged portion. The invention provides a method to install a sealing fin in a continuous fashion around a window or door opening.

17 Claims, 6 Drawing Sheets

REPLACEMENT WINDOW AND DOOR SEALING FIN AND METHOD

BACKGROUND OF THE INVENTION

1. Field of the Invention

The present invention relates generally to sealing replacement windows and doors and specifically to a replacement window and door sealing fin and method for installing same.

2. Description of the Prior Art

Almost every commercial and residential structure has windows and doors. Water damage around such openings is one of the most common factors leading to premature failure in building structures. An original window is generally installed in an opening using a frame with an integrated nailing fin. The fin serves two purposes, to secure the window to the structure and to help prevent the infiltration of water, air, and insects around the window's perimeter. An original door generally has a gap between the door frame and the building structure that defines the door opening. In most cases, there is little or no fin or barrier within this gap that prevents air, water and insect penetration.

In the residential context, there is a fairly standard method for window and door replacement. Regarding windows, this method involves removing the entire window from an opening and replacing it with a replacement window. In the process of removing the window, the nailing fin is also removed or otherwise damaged. Thus, an important protective weather barrier is undesirably eliminated. Unfortunately, the exterior material of the structure often prevents the replacement window from being secured by nailing fins in the same manner as the original window. Rather, when the replacement window is installed, the window is simply placed in the opening, fastened, and sealed with a caulking material. This method, however, is ineffective in preventing water infiltration between the structure wall and the exterior material. Not surprisingly, replacement windows often allow moisture, air, and insects to penetrate interior materials of the structure such as structural framing, sheetrock and drywall. With respect to door replacement, the process of replacing the door involves removing the door and inserting a new door in the same opening from which the original was removed. In most cases, the replacement door is inserted in the same manner as the original, and the gap between door and structure remains.

What is needed is a replacement window and door sealing fin that prevents moisture, air, and insects from penetrating the interior materials of a structure.

SUMMARY OF THE INVENTION

It is an object of the invention to provide a replacement window and door sealing fin and method that prevents moisture, air, and insects from penetrating the interior materials of a structure.

The present invention provides an economical replacement window and door sealing fin that is easy to install and prevents moisture, air and insects from penetrating sheetrock, drywall and other interior materials. The sealing fin is elongated, and comprises a central fin portion intersecting a crosspiece portion perpendicular thereto, the two portions together generally form a "T" shape. The crosspiece and central fin are each formed from thin, flat, generally rectangular sheets of flexible material. In one aspect of the invention, the central fin is coupled to the crosspiece such that said central fin may be folded to lay flat against the crosspiece. When the central fin is in this folded position, the sealing fin may be easily rolled.

In one aspect of the present invention, the sealing fin is "L" shaped.

In one aspect of the present invention, the sealing fin is further comprised of an adhesive layer on one or more surfaces.

In another aspect of the present invention, the adhesive layer is covered with a removable portion.

In another aspect of the present invention, the sealing fin is constructed from a rigid material such as aluminum or vinyl.

In another aspect of the present invention, the sealing fin has a rectangular configuration.

In another aspect of the present invention, the sealing fin has a rectangular configuration with a hinged portion that permits the sealing fin to be installed in one piece within a window or door opening.

The present invention also provides a method of installing a replacement window sealing fin in a continuous fashion around a perimeter of a window opening, wherein said perimeter is comprised of a stud, sheathing, and an exterior material, and wherein said sealing fin is comprised of a crosspiece and a central fin and first and a second ends. The method of the present invention generally comprises selecting a length of the sealing fin; inserting the first end of the sealing fin in a portion of the window opening such that said central fin is placed between said exterior and sheathing; continuing to insert portions of said sealing fin in the window opening such that successive portions of said central fin are placed between successive portions of said sheathing and exterior; and securing said second end.

In accordance with another aspect of the present invention, the method of installing the sealing fin in a window opening further includes forming a sill portion in a lower portion of said window opening wherein said sill portion is formed by inserting a portion of said crosspiece between a portion of the sheathing and a portion of the exterior material.

In accordance with another aspect of the present invention, the method of installing the sealing fin in a window opening further includes trimming the sill portion on the sides to form a trimmed portion; positioning a replacement window in the opening, wherein said replacement window has a frame, an interior and an exterior; filling an air-space between the frame and sealing fin with a foam sealing material; trimming the sealing fin and foam flush with the replacement window frame, and caulking the frame on the exterior and interior.

In accordance with another aspect of the method of installing the sealing fin in a window opening, the step of securing said second end further includes securing said second end to the first end such that said second end overlaps said first end.

The present invention also provides a method of installing a door sealing fin in a continuous fashion around a perimeter of a door opening in a building structure, wherein said perimeter is comprised of a stud, sheathing, door sill, and an exterior material, and wherein said sealing fin is comprised of a crosspiece and a central fin and first and a second ends. The method of installing a door sealing fin generally comprises selecting a length of the sealing fin; inserting the first end of the sealing fin in a portion of the door opening such that said central fin is placed between said exterior material and sheathing; continuing to insert portions of said sealing fin in the door opening such that successive portions of said central fin are placed between successive portions of said exterior material and sheathing; and securing said second end.

In accordance with another aspect of installing a door sealing fin, the method includes positioning a door in the door opening, wherein said door has a frame, an interior and an exterior; filling an air-space between the frame and building structure with a foam sealing material; trimming the sealing fin and foam flush with the door frame, and caulking the frame on the exterior and interior.

DESCRIPTION OF THE PREFERRED EMBODIMENT

Figure 1:
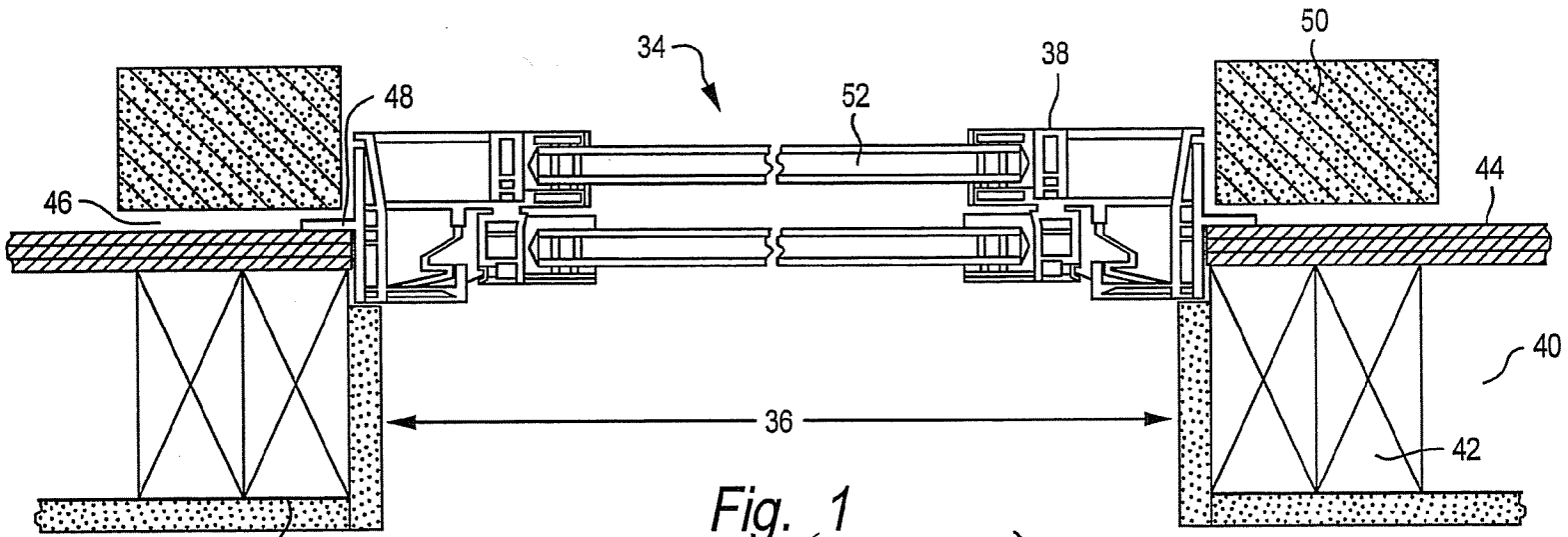
Fig. 1 (Prior Art)
FIG. 1 is a top side view of a prior art conventional window assembly.

Referring to FIG. 1 there is shown a conventional window assembly 34. This assembly 34 is comprised of an original window 52 having a frame 38 and a nail fin 48. The window 52 is disposed within an opening 36 in a wall 40. The wall 40 is comprised of studs 42, an interior material 54 such as structural framing, drywall or sheetrock, and sheathing 44. The window assembly 34 is further comprised of an exterior material 50 such as brick, masonry, or other exterior siding.

Figure 9:
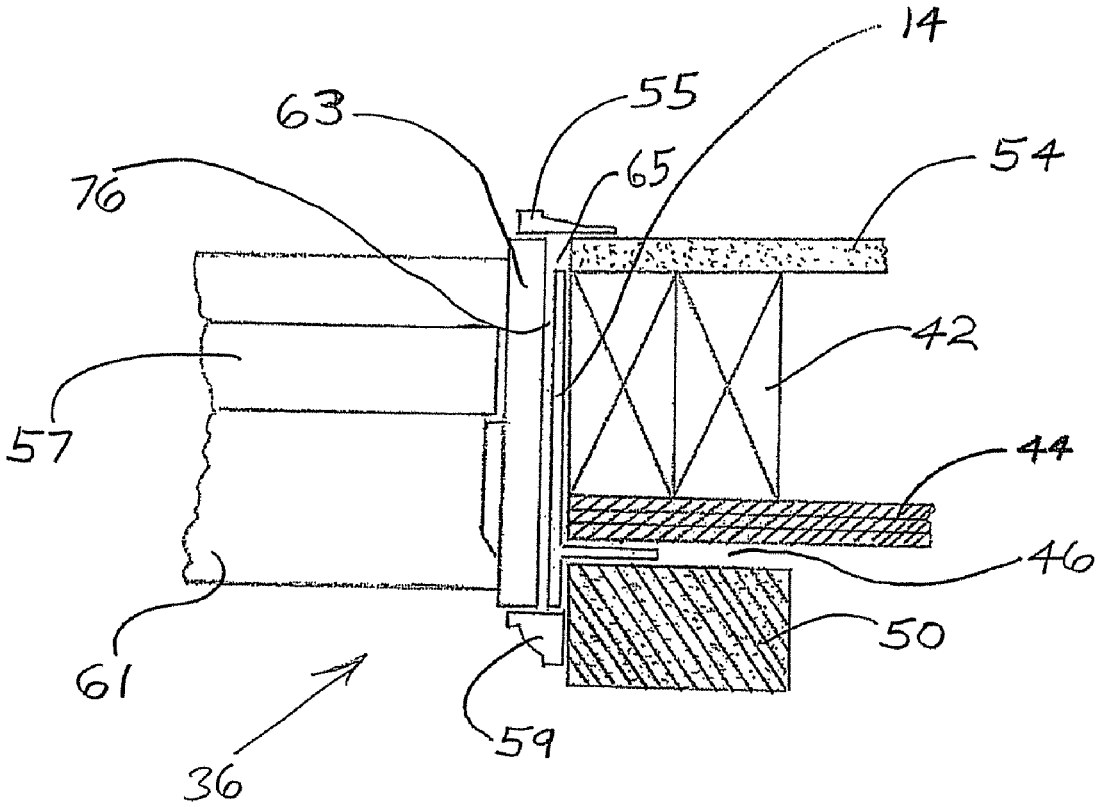
FIG. 9 is a top view of the sealing fin installed in the side of a door opening, in accordance with a preferred embodiment.

Referring to FIGS. 2-9, there is shown a replacement window and door sealing fin 14 for use in the installation of a replacement window 56 or door 57 within a rough opening 36. The rough opening 36 is located within a wall 40, the wall being comprised of studs 42, an interior material 54 and an exterior material 50. The replacement window and door sealing fin 14 may be fitted into a variety of rough opening 36 sizes by varying an amount of overlap of portions of the sealing fin 14. In FIG. 9, there is shown a top view of a door opening 36 with a replacement window and door sealing fin 14 in place. The door opening 36 is comprised of studs 42, an interior material 54 and an exterior material 50, interior casing 55, brick mold 59, door frame 63, a door 57 having a frame 63, and door sill 61.

The sealing fin 14 is elongated, and is comprised of a central fin 16 and a crosspiece 26, each having a length. The crosspiece 26 is an elongated thin, flat, generally rectangular sheet of flexible material and is further comprised of a top surface 28 and a lower surface 34. The central fin 16 is also a thin, flat, generally rectangular sheet of material that extends longitudinally from the lower surface 34 of the crosspiece 26 such that said crosspiece 26 length is generally parallel to said central fin 16 length. In the preferred embodiment, the central fin 16 and crosspiece 26 lengths are approximately equal, and the central fin 16 generally extends perpendicularly from a position offset, but parallel, to the longitudinal center of the crosspiece 26. Thus, the central fin 16 and crosspiece 26 generally form a modified "T" shape cross-section when viewed along a longitudinal axis of the sealing fin 14. Because the central fin 16 of the preferred embodiment is offset from the longitudinal center of the crosspiece 26, the crosspiece 26 has a narrow side 18 and a wide side 20. However, the central fin 16 need not intersect the crosspiece 26 at a position offset from the longitudinal center. Rather, in another embodiment of the present invention, the central fin 16 intersects the crosspiece 26 along the longitudinal center. In still another embodiment, the central fin 16 intersects the crosspiece near one of the crosspiece 26 longitudinal edges such that an "L" shape is formed when viewed in cross-section along the longitudinal axis of the sealing fin 14.

Because the sealing fin 14 is intended to act as a moisture barrier, it is desirable that the sealing fin 14 be generally impervious to water such that moisture is unable to penetrate it. In the preferred embodiment, the replacement window and door sealing fin 16 is formed from a single piece of material. In this embodiment, the sealing fin 14 is a thick, yet flexible polypropylene and is formed by an extrusion process. However, the sealing fin 14 need not be formed from a single piece of material and need not be formed from polypropylene. Rather, the sealing fin 14 may be formed from a plurality of pieces and may be formed from such materials as vinyl or aluminum. Alternatively, a fibrous material or a synthetic rubber material such ethylene propylene diene M-class rubber (EPDM) may be used. The sealing fin 14 need not be formed by an extrusion process. Rather, any suitable manufacturing process may be utilized such as molding.

In an alternative embodiment of the invention, the replacement sealing fin 14 is made of a more rigid material such as vinyl, aluminum, and the like.

In one embodiment, the central fin 16 is a thicker material than the crosspiece 26, so the central fin 16 can be more easily positioned between the structure 42 and the sheathing 44 or between the sheathing 44 and exterior material 50 without collapsing. In this embodiment, the material is more rigid in the central fin 16, and more flexible in the crosspiece 26. In this embodiment, the sealing fin 14 better resists collapse but can also be easily bent and stretched around a corner.

Figure 2B:
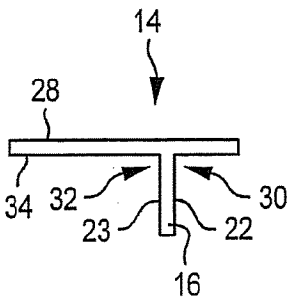
FIG. 2B is a side plan view of the sealing fin, in accordance with a preferred embodiment.
Figure 2A:
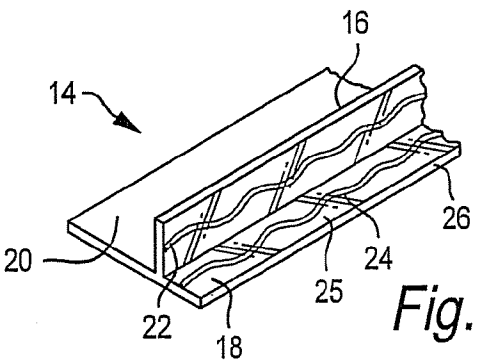
FIG. 2A is an isometric view of the sealing fin showing the central fin and lower surface of the crosspiece, in accordance with a preferred embodiment.

Referring to FIGS. 2A and 2B, the lower surface 34 of the crosspiece 26 has a left lower surface 18 and a right lower surface 20, said surfaces 18, being defined by the intersection of the central fin 16. The central fin 16 has a left side surface 22 and a right side surface 23, the left side surface 22 being adjacent to the left lower surface 18 of the crosspiece 26, and the right side surface 23 being adjacent to the right lower surface 20 of the crosspiece 26. The left lower surface 18 of the crosspiece 26 and left side surface 22 of the central fin 16 define an inner lip 30. As may be seen in FIG. 4, this inner lip 30 may be placed within the brick pocket 46 such that the surfaces 18, 22 comprising the inner lip 30 are adjacent to the sheathing 44. The right lower surface 20 of the crosspiece 26 and right side 23 of the central fin 16 define an outer lip 32. The outer lip 32 overlays the exterior 50, and may extend beyond the area on which the newly installed replacement window 56 will contact. Although in the preferred embodiment, the central fin 16 is placed between the exterior material 50 and the sheathing 44, it need not be so placed. Rather, the central fin 16 may be placed between the stud 42 and the sheathing 44.

Figure 4:
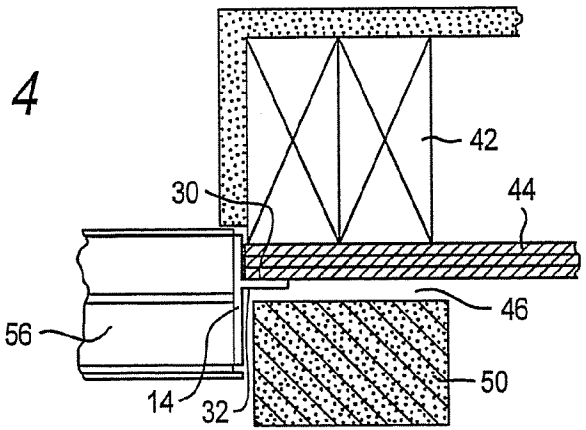
FIG. 4 is a top side view of the sealing fin installed in the top and side of a window opening, in accordance with a preferred embodiment.

Referring to FIG. 2A, in one aspect of the invention, the sealing fin 14 is further comprised of an adhesive material 24 which, at least partially, covers the surfaces 18, 22 comprising the inner lip 30. In this embodiment, the inner lip 30 bonds to the exterior sheathing 44 of the rough opening such that the surfaces 18, 22 comprising the inner lip 30 adhere to the sheathing 44 (FIGS. 4 & 9). This adhesive material 24 is covered, as depicted in FIG. 2A, with a cover 25 such as a film 25. This cover 25 may be easily removed by the user prior to installation of the sealing fin 14. Upon removal of the cover 25, the adhesive material 24 is exposed.

The dimensions of the sealing fin 14 are dependent primarily upon the particular intended application; however, in a typical embodiment, the overall sealing fin 14 will have a width of about six inches and an overall height of about 2 inches, more or less, depending upon the application. The thickness of the central fin and crosspiece may vary from 1/16"-1/8". These dimensions may vary, and may be smaller or larger.

Figure 3:
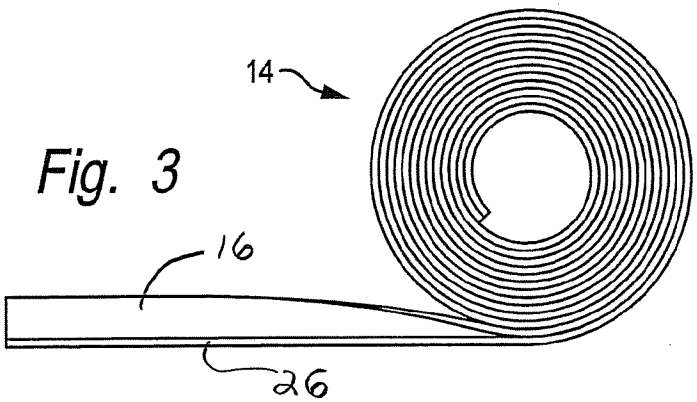
FIG. 3 is side view of the sealing fin in a partially rolled configuration, in accordance with a preferred embodiment.

In a preferred embodiment, the sealing fin 14 is flexible enough to be rolled. As shown in FIG. 3, in a preferred embodiment, the sealing fin 14 may be stored and shipped in a large roll prior to installation. In this embodiment, material from the roll may be removed at the job site, cut to a desired length, and installed within the window or door opening 36.

Figure 5B:
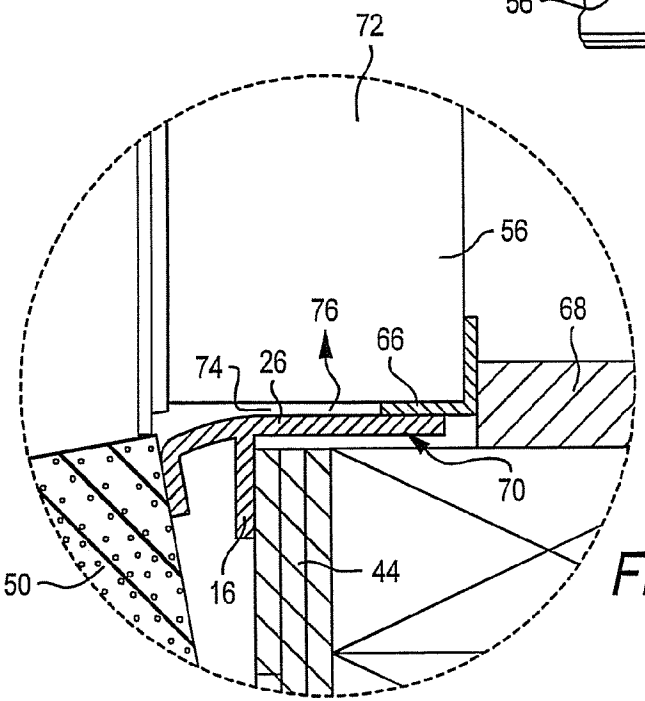
FIG. 5B is a close-up view of the circled portion of FIG. 5B.
Figure 5A:
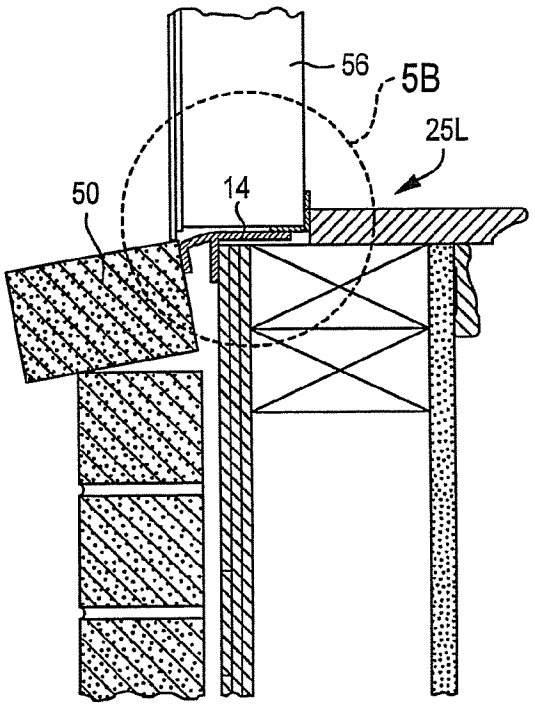
FIG. 5A is a side view of the sealing fin installed in bottom of a window opening, in accordance with a preferred embodiment.
Figure 6:
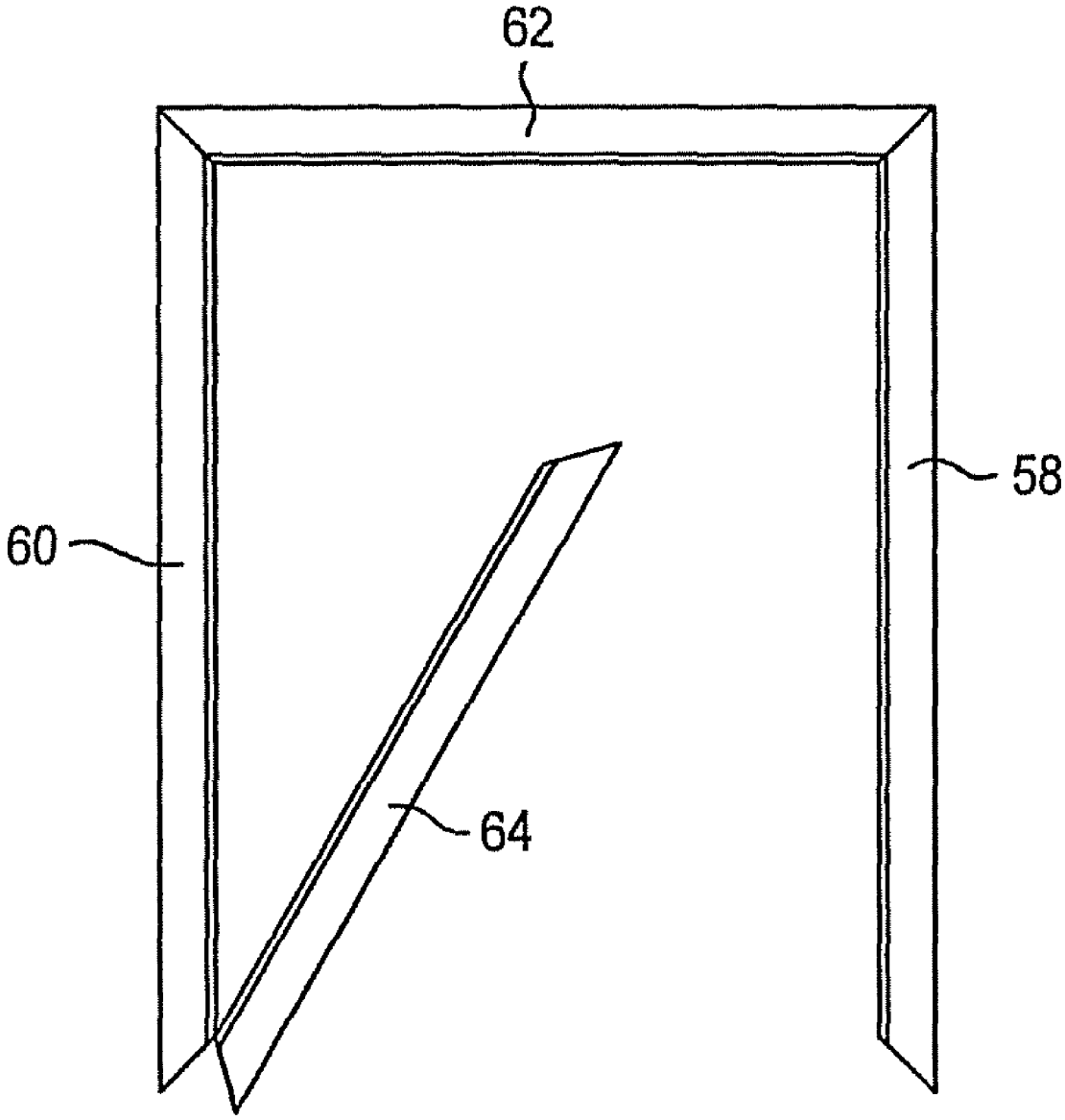
FIG. 6 is a front elevation view of the sealing fin, in accordance with another embodiment.
Figure 7:
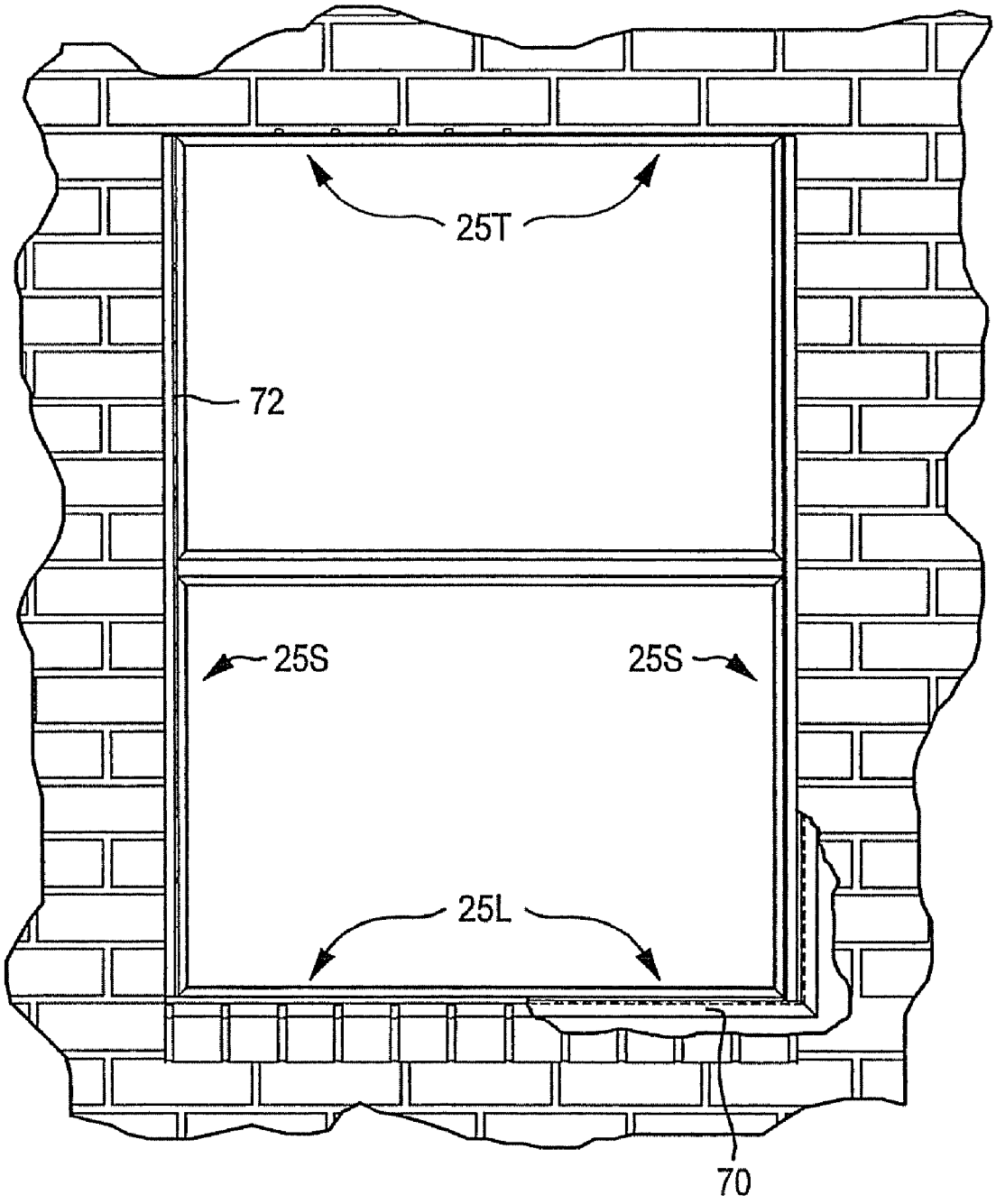
FIG. 7 is an exterior elevation view of a window opening with a replacement window in place.
Figure 8:
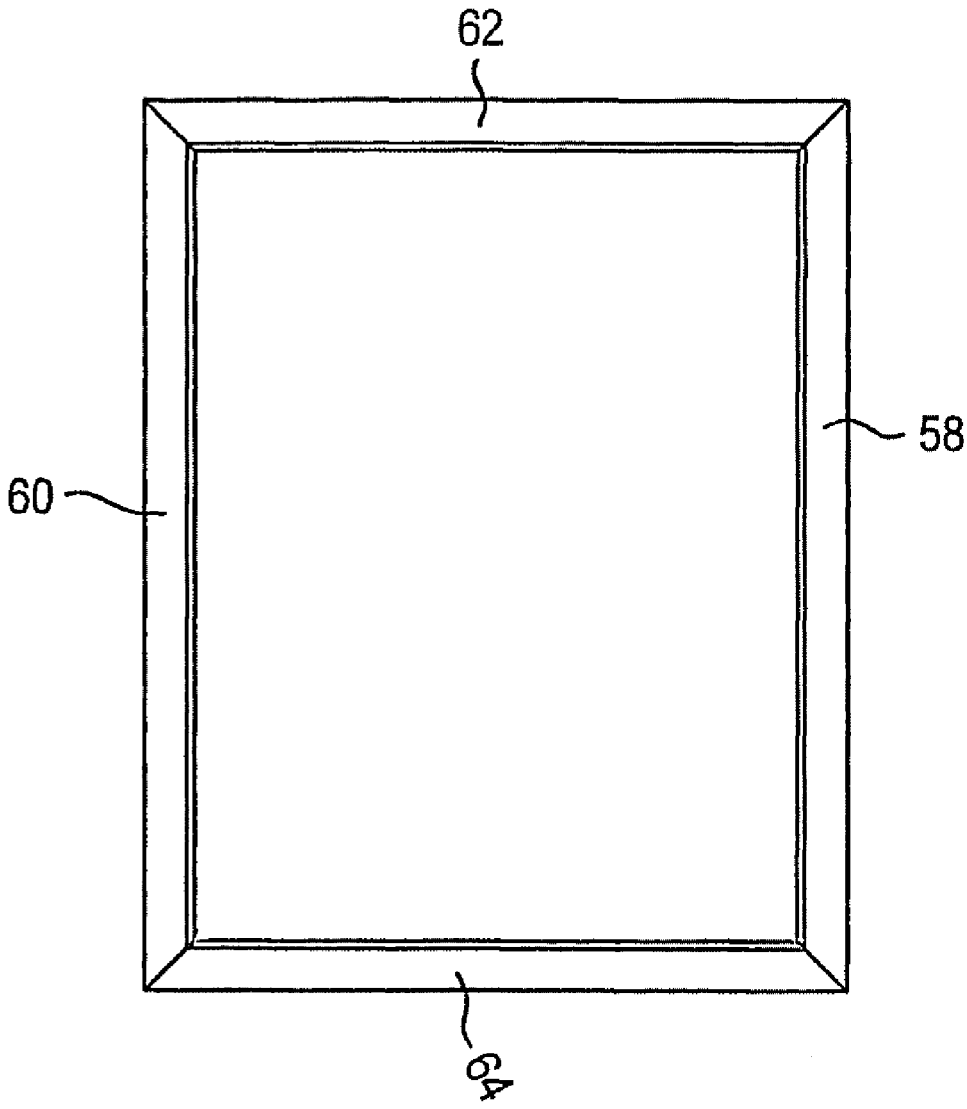
FIG. 8 is a front elevation view of the sealing fin, in accordance with another embodiment.

In a preferred application, the sealing fin 14 is positioned in the opening 36 through the use of the flexible lineal sections. Referring to FIGS. 4-6 the central fin 16 of the sealing fin 14 is placed within a space between an exterior 50 and sheathing 44 on the sides 25 S, 25 S and top 25 T of a window opening 36. In a lower opening 25 L, the central fin 16 may also be inserted between the sheathing 44 and exterior 50 as described above. However, and referring to FIGS. 5A and 5B, in the lower opening 25 L, the crosspiece 26 wide side 20 may be bent at an angle and inserted between the sheathing 44 and the exterior material 50 along with the central fin 16.

Referring to FIG. 6, in another aspect of the present invention, the sealing fin 14 has a rectangular frame configuration with a hinged portion 64 that permits the sealing fin 14 to be installed in one piece within a window 56 or door 57 opening 36. In this embodiment, the sealing fin 14 is formed from a rigid material such as vinyl or aluminum. The material is molded such that the sealing fin 14 is comprised of three 90 degree bends or elbows. As may be seen in FIG. 6, in a preferred embodiment, side portions 58, 60 are coupled to a top portion 62. Hinged portion 64 is hingedly attached to side portion 60. In this embodiment, the sealing fin 14 may be easily placed in position within a window 56 or door 57 opening 36. Because of the open hinged portion 64, the sealing fin 14 may be maneuvered in a manner that might under certain circumstance be difficult if said sealing fin 14 were a closed rectangle. Although in a preferred embodiment the hinged portion 64 is adjacent to a side portion 58, 60, the hinged portion 64 can be any one of the four portions that comprise the rectangular frame 14. Although the rectangular sealing fin 14 of a preferred embodiment is comprised of a hinged portion 64, the sealing fin 14 need not have such a portion 64. Rather, referring to FIG. 8, the rectangle sealing fin 14 may be closed and inserted within a window 56 or door 57 opening 36 as a single unit.

The present invention also provides a method of installing a replacement window sealing fin 14 in a continuous fashion around a perimeter of a window opening 36, wherein said perimeter is comprised of a stud 42, sheathing 44, and an exterior material 50, and wherein said sealing fin 14 is comprised of a crosspiece 26 and a central fin 16 and first and a second ends. The method of the present invention generally comprises selecting a length of the sealing fin 14; inserting the first end of the sealing fin 14 in a portion of the window opening 36 such that said central fin 16 is placed between said exterior 50 and sheathing 44; continuing to insert portions of said sealing fin 14 in the window opening 36 such that successive portions of said central fin 14 are placed between successive portions of said exterior 50 and sheathing 44; and securing said second end.

In accordance with another aspect of the present invention, the method of installing a sealing fin within a window opening 36 further includes forming a sill portion 70 in a lower portion 25 L of said window opening 36 wherein said sill portion 70 (FIGS. 5A, 5B, and 7) is formed by inserting a portion of said crosspiece 26 between a portion of the sheathing 44 and a portion of the exterior material 50. Referring to FIG. 5B, a sealing strip 66 such as tape is placed between the sealing fin 14, a sill 68, and the replacement window 56, such that air, moisture and insects are inhibited from penetrating in the interior of the structure.

In accordance with another aspect of the present invention, the method of installing a sealing fin within a window opening further includes trimming the sill portion 70 to form a trimmed portion; positioning a replacement window 56 in the opening 36, wherein said replacement window 56 has a frame 72, an interior and an exterior; filling an air-space 74 between the frame 72 and sealing fin 14 with a foam sealing material 76; trimming the sealing fin 14 and foam 76 flush with the replacement window frame 72, and caulking the frame 72 on the exterior and interior.

In accordance with another aspect of the method of installing a sealing fin within a window opening 36, the step of securing said second end further includes securing said second end to the first end such that said second end overlaps said first end.

In accordance with another aspect of the method of installing a sealing fin 14 within a window opening 36, the step of inserting the first end of the sealing fin 14 in a portion of the Window opening 36 includes inserting the first end of the sealing fin 14 in a portion of the window opening 36 such that said central fin 16 is placed between said stud 42 and sheathing 44.

The present invention also provides a method of installing a door sealing fin 14 in a continuous fashion around a perimeter of a door opening 36, wherein said perimeter is comprised of a stud 42, sheathing 44, door sill, and an exterior material 50, and wherein said sealing fin 14 is comprised of a crosspiece 26 and a central fin 16 and first and a second ends. The method of installing a door sealing fin 14 generally comprises selecting a length of the sealing fin 14; inserting the first end of the sealing fin 14 in a portion of the door opening 36 such that said central fin 16 is placed between said sheathing 44 and exterior 50; continuing to insert portions of said sealing fin 14 in the door opening 36 such that successive portions of said central fin 14 are placed between successive portions of said exterior 50 and sheathing 44; and securing said second end.

In accordance with another aspect of the present invention, the method of installing a door sealing fin 14 further includes positioning a door 57 in the opening 36, wherein said door 57 has a frame 63, an interior and an exterior; filling an air-space 65 between the frame 63 and sealing fin 14 with a foam sealing material 76; trimming the sealing fin 14 and foam 76 flush with the door frame 63, and caulking the frame 63 on the exterior and interior.

In accordance with another aspect of the method of installing a sealing fin within a door opening, the step of inserting the first end of the sealing fin 14 in a portion of the door opening 36 includes inserting the first end of the sealing fin 14 in a portion of the door opening 36 such that said central fin 16 is placed between said stud 42 and sheathing 44.

The operation and use of the sealing fin 14 will now be described. With respect to a window 56, the sealing fin 14 is installed in a continuous fashion around the window opening 36 and then sealed in a lower side 25 S corner with a sill portion 70 running up a vertical side approximately four inches and then overlapped with the vertically-run side layer. The central fin 14 is placed between the sheathing 44 and the exterior 50 to protect against water and air infiltration. The sill portion 70 of the sealing fin 14 is trimmed to protect the interior and to allow water flow should the window frame 56 leak.

With respect to a door 57, the sealing fin 14 is installed in a continuous fashion around the door opening 36 and then sealed in a lower side 25 S corner. The central fin 14 is placed between the sheathing 44 and the exterior 50 to protect against water and air infiltration.

Once the sealing fin 14 has been applied around the perimeter of the opening 36, the replacement window 56 or door 57 is positioned in the opening 36, shimmed and secured. The resulting air-space 74 (FIG. 5B), 65 (FIG. 9) between the sealing fin 14 and the window frame 72 or door frame 63 can now be filled with a low-expansion rate foam 76. Expanding foam 76 will be necessary in the instance that the opening 36 is irregular or larger than the replacement window 56 or door 57 and to allow for proper shimming. When the spray foam 76 material has dried, the excess replacement sealing fin 14 and spray foam 76 are trimmed flush with the replacement window frame 56 or door frame 57. Finally, the frame 56, 57 is caulked on the exterior 50 and interior 54.

The replacement window and door sealing fin 14 and methods described herein are suitable for use in a variety of windows 56 and doors 57 in a variety of structures. For example, the invention may be used to replace patio and other sliding glass doors 57, as well as for original door 57 installation and replacement door 57 installation.

While there has been illustrated and described what is, at present, considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of the appended claims.

I claim:

1. A replacement window and door sealing fin capable of being used to seal a perimeter of a replacement window or door, said sealing fin comprising:

A flexible central fin and crosspiece, said central fin and crosspiece each having a length, said crosspiece having edges corresponding to the length of said crosspiece, said central fin extending perpendicularly from a surface between the edges of the crosspiece such that said crosspiece length is generally parallel to said central fin length, wherein said central fin, when oriented in a first position, lays flat against the crosspiece surface such that said sealing fin may be rolled into a spooled configuration, wherein said central fin, when oriented in a second position, extends outward from said crosspiece, and wherein said sealing fin in said second position is capable of sealing a perimeter of a replacement window or door.

2. The replacement window and door sealing fin of claim 1 wherein said central fin, when oriented in said second position, generally extends perpendicularly from a crosspiece surface centered between the edges such that said central fin and crosspiece may generally form a "T" shape when viewed in cross-section from an end of said sealing fin.

3. The replacement window and door sealing fin of claim 1 wherein said central fin, when oriented in said second position, generally extends perpendicularly from a crosspiece surface offset between the edges from center of the crosspiece such that said central fin and crosspiece may generally form an "L" shape when viewed in cross-section from an end of said sealing fin.

4. The replacement window and door sealing fin of claim 1 wherein said central fin has an adhesive layer on one or more surfaces.

5. The replacement window and door sealing fin of claim 4 wherein said adhesive layer is covered with a removable layer.

6. The replacement window and door sealing fin of claim 1 wherein said sealing fin has a rectangular configuration.

7. The replacement window and door sealing fin of claim 6 wherein said sealing fin has a rectangular configuration with a hinged portion that permits the sealing fin to be installed in one piece within a window opening.

8. The replacement window and door sealing fin of claim 1 wherein said central fin is thicker than said crosspiece.

9. A method of installing a replacement window sealing fin around a perimeter of a window opening, wherein said perimeter is comprised of a stud, sheathing, and an exterior material, and wherein said sealing fin is flexible and comprises a crosspiece, central fin, and first and second ends, and crosspiece edges, wherein said central fin extends perpendicularly from a crosspiece surface between the edges and, when oriented in a first position, lays flat against the crosspiece surface such that said sealing fin may be rolled into a spooled configuration, and wherein said central fin, when oriented in a second position, extends outward from said crosspiece, and wherein said sealing fin in said second position is capable of sealing a perimeter of a replacement window or door;

said method comprising the steps of:

selecting a length of the sealing fin;

inserting the first end of the sealing fin in a portion of the window opening such that said central fin is placed between said exterior material and sheathing;

continuing to insert portions of said sealing fin in the window opening such that successive portions of said central fin are placed between successive portions of said exterior material and sheathing; and securing said second end.

10. The method of installing a replacement window sealing fin of claim 9 further including the step of:

forming a sill portion in a lower portion of said window opening wherein said sill portion is formed by inserting a portion of said crosspiece between a portion of the sheathing and a portion of the exterior material.

11. The method of installing a replacement window sealing fin of claim 10 further including the steps of:

trimming the sill portion on the sides to form a trimmed portion;

positioning a replacement window in the opening, wherein said replacement window has a frame, an interior and an exterior;

filling an air-space between the frame and sealing fin with a foam sealing material;

trimming the sealing fin and foam flush with the replacement window frame;

and caulking the frame on the exterior and interior.

12. The method of installing a replacement window sealing fin of claim 9 wherein the step of securing said second end further includes:

securing said second end to the first end such that said second end overlaps said first end.

13. The method of installing a replacement window sealing fin of claim 9 wherein the sealing fin is inserted between the stud and sheathing.

14. The method of installing a replacement window sealing fin of claim 10 wherein the sill portion is formed by inserting a portion of said crosspiece between a portion of the sheathing and the stud.

15. A method of installing a door sealing fin around a perimeter of a door opening, wherein said perimeter is comprised of a stud, sheathing, and an exterior material, and wherein said sealing fin is flexible and comprises a crosspiece and a central fin and a first and a second end, wherein said central fin extends perpendicularly from a surface between edges of the crosspiece, and, when oriented in a first position, lays flat against the crosspiece surface such that said sealing fin may be rolled into a spooled configuration, and wherein said central fin, when oriented in a second position, extends outward from said crosspiece, and wherein said sealing fin in said second position is capable of sealing a perimeter of a replacement window or door;

said method comprising the steps of:

selecting a length of the sealing fin;

inserting the first end of the sealing fin in a portion of the door opening such that said central fin is placed between said exterior material and sheathing;

continuing to insert portions of said sealing fin in the door opening such that successive portions of said central fin are placed between successive portions of said exterior and sheathing; and securing said second end.

16. The method of installing a door sealing fin of claim 15 wherein the sealing fin is inserted between the stud and sheathing.

17. The method of installing a door sealing fin of claim 15 further including the steps of:

positioning a door in the opening, wherein said door has a frame, an interior and an exterior;

filling an air-space between the frame and sealing fin with a foam sealing material;

trimming the sealing fin and foam flush with the door frame; and caulking the frame on the exterior and interior.

* * * * *